US010920293B2

(12) United States Patent
Takashima et al.

(10) Patent No.: US 10,920,293 B2
(45) Date of Patent: *Feb. 16, 2021

(54) STEEL SHEET AND PLATED STEEL SHEET, METHOD FOR PRODUCING HOT-ROLLED STEEL SHEET, METHOD FOR PRODUCING COLD-ROLLED FULL-HARD STEEL SHEET, METHOD FOR PRODUCING HEAT-TREATED SHEET, METHOD FOR PRODUCING STEEL SHEET, AND METHOD FOR PRODUCING PLATED STEEL SHEET

(71) Applicant: JFE Steel Corporation, Tokyo (JP)

(72) Inventors: Katsutoshi Takashima, Tokyo (JP); Yoshimasa Funakawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 200 days.

This patent is subject to a terminal disclaimer.

(21) Appl. No.: 16/089,096

(22) PCT Filed: Mar. 21, 2017

(86) PCT No.: PCT/JP2017/011078

§ 371 (c)(1),
(2) Date: Sep. 27, 2018

(87) PCT Pub. No.: WO2017/169941

PCT Pub. Date: Oct. 5, 2017

(65) Prior Publication Data

US 2019/0085421 A1 Mar. 21, 2019

(30) Foreign Application Priority Data

Mar. 31, 2016 (JP) ..... 2016-070754

(51) Int. Cl.

| | |
|---|---|
| ***C21D 9/46*** | (2006.01) |
| ***C21D 8/02*** | (2006.01) |
| ***C23C 2/06*** | (2006.01) |
| ***C22C 38/06*** | (2006.01) |
| ***C23C 2/28*** | (2006.01) |
| ***C22C 38/60*** | (2006.01) |
| ***C22C 38/58*** | (2006.01) |
| ***C21D 1/74*** | (2006.01) |
| ***C22C 18/00*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |

(Continued)

(52) U.S. Cl.

CPC ..... *C21D 8/0226* (2013.01); *C21D 1/74* (2013.01); *C21D 8/0236* (2013.01); *C21D 8/0263* (2013.01); *C21D 8/0273* (2013.01); *C21D 9/46* (2013.01); *C22C 18/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/58* (2013.01); *C22C 38/60* (2013.01); *C23C 2/02* (2013.01); *C23C 2/06* (2013.01); *C23C 2/28* (2013.01); *C23C 2/40* (2013.01); *C21D 2211/005* (2013.01); *C21D 2211/008* (2013.01); *C21D 2211/009* (2013.01); *C22C 18/04* (2013.01)

(58) Field of Classification Search

CPC ..... C21D 8/0226; C21D 1/74; C21D 8/0236; C21D 9/46; C21D 38/001; C21D 38/02; C21D 38/04; C21D 36/06; C22C 38/02; C22C 38/04; C22C 38/06; C23C 2/40

See application file for complete search history.

(56) References Cited

U.S. PATENT DOCUMENTS

| | | | |
|---|---|---|---|
| 2013/0323112 | A1 | 12/2013 | Okamoto et al. |
| 2014/0193667 | A1 | 7/2014 | Shuto et al. |

(Continued)

FOREIGN PATENT DOCUMENTS

| | | | |
|---|---|---|---|
| CN | 101139684 | A | 3/2008 |
| JP | 3516747 | B2 | 4/2004 |

(Continued)

OTHER PUBLICATIONS

International Search Report and Written Opinion for International Application No. PCT/JP2017/011078, dated Jun. 20, 2017—6 pages.
Non Final Office Action for U.S. Appl. No. 16/087,931, dated Jun. 15, 2020, 10 pages.
Final Office Action for U.S. Appl. No. 16/087,931, dated Sep. 8, 2020, 7 pages.

*Primary Examiner* — Scott R Kastler
(74) *Attorney, Agent, or Firm* — RatnerPrestia

(57) ABSTRACT

Provided herein is a plated steel having high strength with excellent elongation, excellent hole expansibility, and excellent material uniformity, and a method for producing such a plated steel. The steel sheet provided herein has a specific composition, and a steel structure that contains ferrite as a primary phase, and 2 to 12% of perlite, and 3% or less of martensite by volume, and in which the remainder is a low-temperature occurring phase. The ferrite has an average crystal grain diameter of 25 μm or less. The perlite has an average crystal grain diameter of 5 μm or less. The martensite has an average crystal grain diameter of 1.5 μm or less. The perlite has a mean free path of 5.5 μm or more. The steel sheet has a tensile strength of 440 MPa or more.

24 Claims, No Drawings

(51) Int. Cl.

| | |
|---|---|
| ***C22C 38/16*** | (2006.01) |
| ***C22C 38/18*** | (2006.01) |
| ***C23C 2/02*** | (2006.01) |
| ***C23C 2/40*** | (2006.01) |
| *C22C 18/04* | (2006.01) |

(56) References Cited

U.S. PATENT DOCUMENTS

| | | | | |
|---|---|---|---|---|
| 2014/0234655 | A1* | 8/2014 | Takashima | C22C 38/06 428/659 |
| 2014/0261914 | A1 | 9/2014 | Jamwal et al. | |
| 2015/0017472 | A1 | 1/2015 | Kimura | |
| 2019/0078173 | A1* | 3/2019 | Takashima | C22C 38/12 |
| 2019/0085421 | A1* | 3/2019 | Takashima | C22C 38/58 |
| 2019/0085427 | A1 | 3/2019 | Takashima et al. | |

FOREIGN PATENT DOCUMENTS

| | | | |
|---|---|---|---|
| JP | 2005298956 | A | 10/2005 |
| JP | 3875792 | B2 | 1/2007 |
| JP | 2015151600 | A | 8/2015 |
| WO | 2012121219 | A1 | 9/2012 |
| WO | 2013015428 | A1 | 1/2013 |

* cited by examiner

STEEL SHEET AND PLATED STEEL SHEET, METHOD FOR PRODUCING HOT-ROLLED STEEL SHEET, METHOD FOR PRODUCING COLD-ROLLED FULL-HARD STEEL SHEET, METHOD FOR PRODUCING HEAT-TREATED SHEET, METHOD FOR PRODUCING STEEL SHEET, AND METHOD FOR PRODUCING PLATED STEEL SHEET

CROSS REFERENCE TO RELATED APPLICATIONS

This is the U.S. National Phase application of PCT/JP2017/011078, filed Mar. 21, 2017, which claims priority to Japanese Patent Application No. 2016-070754, filed Mar. 31, 2016 the disclosures of these applications being incorporated herein by reference in their entireties for all purposes.

FIELD OF THE INVENTION

The present invention relates to a steel sheet and a plated steel sheet, and to a method for producing a hot-rolled steel sheet, a method for producing a cold-rolled full-hard steel sheet, a method for producing a heat-treated sheet, a method for producing a steel sheet, and a method for producing a plated steel sheet.

BACKGROUND OF THE INVENTION

Today's increasing environmental awareness has created stricter regulations on $CO_2$ emissions, and the automobile industry faces the challenge of making lighter vehicles for improved fuel consumption. To this end, sheet sheets having a tensile strength (TS) of 440 MPa or more have been used not only for frame members of automobiles, but for outer panels of automobiles, including covering parts such as the roof and doors. When used for outer panels of automobiles, the steel sheet is galvanized to prevent rusting in the outdoor environment where the steel sheet is exposed.

Steel sheets tend to be less ductile as the strength increases, and, in order to provide the required shapes for different parts, steel sheets need to have desirable ductility (elongation), and desirable stretch flangeability (hole expansion formability). Particularly, a steel sheet used to form a component of a complex shape is required to satisfy both of these properties—elongation and hole expansion formability—at the same time, in addition to individually satisfying desirable elongation and hole expansion formability.

However, strengthening and thinning of a galvanized steel sheet cause serious deterioration of shape fixability, and it has been common practice to predict a shape change that might occur after the release in stamping, and design a mold taking into account an expected amount of shape change. Here, when the mechanical properties of the steel are greatly different in different parts of the steel as a result of variation in steel quality, the actual change greatly deviates from the amount of change expected from when the quality is the same. This causes a shape defect, and necessitates making adjustments, such as reshaping individual parts by sheet-metal working after press forming, with the result that the efficiency of mass production greatly decreases. A galvanized steel sheet is therefore required to have as small a variation of tensile strength and yield strength as possible (or improve material uniformity). For example, PTL 1 discloses a method for obtaining a cold-rolled steel sheet of excellent material uniformity in which the material is hot rolled with rolls that are lubricated with a lubricant supplied by a water injection method. PTL 2 discloses a method for obtaining a cold-rolled steel sheet that is non-aging at ordinary temperature and for use in deep drawing. In this method, solid solution nitrogen is reduced to improve material uniformity along the longitudinal direction of a coil.

PATENT LITERATURE

PTL 1: Japanese Patent No. 3875792
PTL 2: Japanese Patent No. 3516747

SUMMARY OF THE INVENTION

However, the techniques disclosed in PTL 1 and PTL 2 are techniques for ferrite single phase, and do not use a composition that can provide high strength and high ductility. Accordingly, a tensile strength of 440 MPa or more, and material uniformity cannot be satisfied with these techniques. It is accordingly an object according to aspects of the present invention to find a solution to the problems of the related art, and provide a high-strength plated steel sheet having excellent elongation, excellent hole expansion formability, and excellent material uniformity, and a method for producing such a plated steel sheet. Aspects of the present invention are also intended to provide a steel sheet needed to obtain such a plated steel sheet, a method for producing a hot-rolled steel sheet needed to obtain such a plated steel sheet, a method for producing a cold-rolled full-hard steel sheet needed to obtain such a plated steel sheet, a method for producing a heat-treated sheet needed to obtain such a plated steel sheet, and a method for producing a steel sheet needed to obtain such a plated steel sheet.

The present inventors conducted intensive studies, and found the following with respect to the ways elongation, hole expansion formability, and material uniformity can be improved while maintaining high strength. First, elongation and hole expansion formability can be improved by controlling the volume fractions of different phases of a steel structure in specific proportions. Secondly, material uniformity can be improved by varying the rolling conditions of hot rolling, and controlling the amount of perlite generation. The following describes this more specifically.

It is known that high strength can be obtained when a micro structure contains hard perlite or martensite, or a low-temperature occurring phase, in addition to soft ferrite. However, increased strength results in poor elongation and poor hole expansion formability. Hole expansion formability, in particular, involves formation of voids at the interface between soft ferrite, and perlite, martensite, and a low-temperature occurring phase during punching, and these voids become an initiation point of cracks, and causes cracking in the subsequent hole expansion. After intensive studies, the present inventors have found that such void generation during punching can be reduced, and strength can be improved without deteriorating elongation and hole expansion formability when the volume fraction of perlite is 2 to 12%, and the volume fraction of fine martensite is 3% or less. It was also found that uniform mechanical properties can be obtained in a coil along its width and longitudinal directions, and the joining of voids during hole expansion can be controlled for improved hole expansion formability by controlling conditions such as the amount of generated perlite, martensite, or low-temperature occurring phase under controlled rolling conditions in hot rolling.

Aspects of the present invention have been completed on the basis of these findings, and aspects of the present invention are as follows.

[1] A steel sheet of a composition comprising, in mass %, C: 0.07 to 0.19%, Si: 0.09% or less, Mn: 0.50 to 1.60%, P: 0.05% or less, S: 0.01% or less, Al: 0.01 to 0.10%, N: 0.010% or less, and the balance Fe and unavoidable impurities, and of a micro structure that contains ferrite as a primary phase, and 2 to 12% of perlite, and 3% or less of martensite by volume, and in which the remainder is a low-temperature occurring phase, the ferrite having an average crystal grain diameter of 25 μm or less, the perlite having an average crystal grain diameter of 5 μm or less, the martensite having an average crystal grain diameter of 1.5 μm or less, and the perlite having a mean free path of 5.5 μm or more.

[2] The steel sheet according to item [1], wherein the composition further comprises, in mass %, one or more selected from Nb: 0.10% or less, Ti: 0.10% or less, and V: 0.10% or less.

[3] The steel sheet according to item [1] or [2], wherein the composition further comprises, in mass %, one or more selected from Cr: 0.50% or less, Mo: 0.50% or less, Cu: 0.50% or less, Ni: 0.50% or less, B: 0.01% or less, and a total of 0.0050% or less of Ca and/or REM.

[4] A plated steel sheet comprising a plating layer on a surface of the steel sheet of any one of items [1] to [3].

[5] The plated steel sheet according to item [4], wherein the plating layer is a hot-dip galvanized layer, or a hot-dip galvannealed layer.

[6] A method for producing a hot-rolled steel sheet, the method comprising:

hot rolling a steel slab of the composition of any one of items [1] to [3] under the conditions where a rolling reduction of a final pass of finish rolling is 12% or more, a rolling reduction of a preceding pass of the final pass is 15% or more, a total rolling reduction of the finish rolling is 85 to 95%, and a finish rolling delivery temperature is 850 to 950° C.;

subjecting the steel after the hot rolling to first cooling in which the steel is cooled to a cooling stop temperature at a first average cooling rate of 50° C./s or more, the cooling stop temperature being 700° C. or less;

subjecting the steel after the first cooling to second cooling in which the steel is cooled to a coiling temperature at a second average cooling rate of 5° C./s or more; and coiling the steel at a coiling temperature of 450 to 650° C.

[7] A method for producing a cold-rolled full-hard steel sheet, the method comprising pickling and cold rolling the hot-rolled steel sheet obtained by the method of item [6].

[8] A method for producing a steel sheet, comprising:

heating the cold-rolled full-hard steel sheet obtained by the method of item [7], the cold-rolled full-hard steel sheet being heated under the conditions where the dew point in a temperature range of 600° C. or more is −40° C. or less, and a maximum achieving temperature is 730 to 900° C.;

retaining the heated sheet at the maximum achieving temperature for a retention time of 15 to 600 seconds; and cooling the retained steel sheet to a cooling stop temperature at an average cooling rate of 3 to 30° C./s, the cooling stop temperature being 600° C. or less.

[9] A method for producing a heat-treated sheet, comprising:

heating the cold-rolled full-hard steel sheet obtained by the method of item [7], the cold-rolled full-hard steel sheet being heated at a heating temperature of 700 to 900° C.; and cooling the cold-rolled full-hard steel sheet.

[10] A method for producing a steel sheet, comprising:

heating the heat-treated sheet obtained by the method of item [9], the heat-treated sheet being heated under the conditions where the dew point in a temperature range of 600° C. or more is −40° C. or less, and a maximum achieving temperature is 730 to 900° C.;

retaining the heated heat-treated sheet at the maximum achieving temperature for a retention time of 15 to 600 seconds; and cooling the retained heat-treated sheet to a cooling stop temperature at an average cooling rate of 3 to 30° C./s, the cooling stop temperature being 600° C. or less.

[11] A method for producing a plated steel sheet, the method comprising plating a surface of the steel sheet obtained by the method of item [8] or [10].

[12] The method according to item [11], wherein the plating is a process that involves hot-dip galvanization, and alloying at 450 to 600° C.

The plated steel sheet obtained in accordance with aspects of the present invention has high strength with excellent elongation, excellent hole expansion formability, and excellent material uniformity. For example, when applied to automobile members, the plated steel sheet according to aspects of the present invention can achieve lightness for improved fuel consumption while ensuring the collision safety of the automobile.

The steel sheet, the method for producing a hot-rolled steel sheet, the method for producing a cold-rolled full-hard steel sheet, the method for producing a heat-treated sheet, and the method for producing a steel sheet according to aspects of the present invention can be used as an intermediate product for obtaining the steel sheet or plated steel sheet of desirable properties above, or as methods for producing such an intermediate product, and contribute to improving the properties of a plated steel sheet.

DETAILED DESCRIPTION OF EMBODIMENTS OF THE INVENTION

An embodiment of the present invention is described below. The present invention, however, is not limited to the following embodiment.

Aspects of the present invention include a steel sheet and a plated steel sheet, and a method for producing a hot-rolled steel sheet, a method for producing a cold-rolled full-hard steel sheet, a method for producing a heat-treated sheet, a method for producing a steel sheet, and a method for producing a plated steel sheet. The following first describes how these are related to one another.

A steel sheet according to aspects of the present invention is an intermediate product for obtaining a plated steel sheet according to aspects of the present invention. In the case of a single method, a starting steel material such as a slab is formed into a plated steel sheet through a manufacturing process that produces a hot-rolled steel sheet, a cold-rolled full-hard steel sheet, and a steel sheet in succession. In the case of a double method, a starting steel material such as a slab is formed into a plated steel sheet through a manufacturing process that produces a hot-rolled steel sheet, a cold-rolled full-hard steel sheet, a heat-treated sheet, and a steel sheet in succession. The steel sheet according to aspects of the present invention is a steel sheet produced in these processes.

The method for producing a hot-rolled steel sheet according to aspects of the present invention is a method that produces the hot-rolled steel sheet in the foregoing process.

The method for producing a cold-rolled full-hard steel sheet according to aspects of the present invention is a method that produces a cold-rolled full-hard steel sheet from the hot-rolled steel sheet in the foregoing process.

In the case of the double method, the method for producing a heat-treated sheet according to aspects of the present invention is a method that produces a heat-treated sheet from the cold-rolled full-hard steel sheet in the foregoing process.

In the case of the single method, the method for producing a steel sheet according to aspects of the present invention is a method that produces a steel sheet from the cold-rolled full-hard steel sheet in the foregoing process. In the case of the double method, the method for producing a steel sheet according to aspects of the present invention is a method that produces a steel sheet from the heat-treated sheet in the foregoing process.

The method for producing a plated steel sheet according to aspects of the present invention is a method that produces a plated steel sheet from the steel sheet in the foregoing process.

Because of these relationships, the hot-rolled steel sheet, the cold-rolled full-hard steel sheet, the heat-treated sheet, the steel sheet, and the plated steel sheet share the same composition, and the steel sheet and the plated steel sheet share the same micro structure. The following describes these common characteristics first, and the steel sheet, the plated steel sheet, and the producing methods.

Composition

The steel sheets according to aspects of the present invention, including the plated steel sheet, have a composition containing, in mass %, C: 0.07 to 0.19%, Si: 0.09% or less, Mn: 0.50 to 1.60%, P: 0.05% or less, S: 0.01% or less, Al: 0.01 to 0.10%, N: 0.010% or less, and the balance Fe and unavoidable impurities.

The composition may further contain, in mass %, one or more selected from Nb: 0.10% or less, Ti: 0.10% or less, and V: 0.10% or less.

The composition may further contain, in mass %, one or more selected from Cr: 0.50% or less, Mo: 0.50% or less, Cu: 0.50% or less, Ni: 0.50% or less, B: 0.01% or less, and a total of 0.0050% or less of Ca and/or REM.

The components are described below. In the following, "%" representing the content of the component means percent by mass.

C: 0.07 to 0.19%

Carbon is an element that is effective at increasing the strength of a steel sheet, and contributes to forming a second phase, which is a phase other than ferrite (Specifically, the second phase means, for example, perlite, martensite, bainite, retained austenite, spherical cementite, and unrecrystallized ferrite). With a C content of less than 0.07%, it becomes difficult to provide the necessary volume fraction for the second phase. For this reason, the C content is 0.07% or more, preferably 0.08% or more. When contained in excess, carbon increases the hardness difference between ferrite and martensite, and lowers hole expansion formability. It also becomes difficult to adjust the volume fraction of a predetermined phase in the desired range. For this reason, the C content is 0.19% or less. The C content is preferably 0.18% or less.

Si: 0.09% or Less

Silicon adds strength to ferrite through solid solution strengthening, and contributes to increasing the hole expansion rate by reducing the hardness difference between ferrite and the second phase. However, silicon concentrates at the steel sheet surface in the form of an oxide during annealing, and deteriorates plateability. For this reason, the Si content is 0.09% or less, preferably 0.07% or less, further preferably 0.05% or less. In view of hole expansion rate, the lower limit is preferably 0.005% or more, though it is not particularly limited.

Mn: 0.50 to 1.60%

Manganese is an element that contributes to solid solution strengthening, and enhancing strength. For this effect, manganese needs to be contained in an amount of 0.50% or more, preferably 0.75% or more. When contained in excess, manganese segregates during casting, and makes it difficult to provide a mean free path for perlite. For this reason, the Mn content is 1.60% or less, preferably 1.50% or less.

P: 0.05% or Less

Phosphorus contributes to enhancing strength through solid solution strengthening. By adjusting the P content, the alloying rate of the plating layer can be controlled to improve plateability. In order to obtain this effect, phosphorus is contained in an amount of preferably 0.001% or more. However, containing an excess amount of phosphorus promotes segregation into grain boundaries, and the hole expansion formability deteriorates. For this reason, the P content is 0.05% or less, preferably 0.04% or less, more preferably 0.03% or less.

S: 0.01% or Less

With a large sulfur content, sulfur produces large amounts of sulfides such as MnS, and these sulfides become an initiation point of voids during punching, and deteriorate hole expansion formability. For this reason, the upper limit of S content is 0.01%, preferably 0.005% or less. The lower limit is not particularly limited. However, an excessively small S content increases the steel production cost, and the S content is preferably 0.0003% or more.

Al: 0.01 to 0.10%

Aluminum is an element that is needed for deoxidation, and needs to be contained in an amount of 0.01% or more to obtain this effect. The Al content is preferably 0.02% or more. An Al content of more than 0.10% saturates the effect, and the Al content is 0.10% or less, preferably 0.05% or less.

N: 0.010% or Less

Nitrogen needs to be contained in a reduced amount because this element forms a coarse nitride, and deteriorates the hole expansion formability. The N content is 0.010% or less because this tendency becomes more pronounced with a N content of more than 0.010%. The N content is preferably 0.008% or less. The lower limit of N content is, for example, 0.001% or more, though it is not particularly limited.

In accordance with aspects of the present invention, the composition may contain one or more of the following components, in addition to the components above.

Nb: 0.10% or Less

Niobium may be contained as required, because this element forms a fine carbonitride or a fine carbide, and can contribute to making a fine micro structure, and improving hole expansion formability. In view of obtaining this effect, niobium is contained in an amount of preferably 0.01% or more, more preferably 0.02% or more. However, adding niobium in large amounts increases the unrecrystallized ferrite, and seriously deteriorates elongation. It also makes it difficult to provide material uniformity. For this reason, the Nb content is preferably 0.10% or less, more preferably 0.05% or less.

Ti: 0.10% or Less

Titanium may be added as required, because this element forms a fine carbonitride or a fine carbide, and can contribute to making a fine fine structure, and improving hole expansion formability. In view of obtaining this effect, titanium is contained in an amount of preferably 0.01% or more, more preferably 0.02% or more. However, adding titanium in large amounts increases the unrecrystallized ferrite, and seriously deteriorates elongation. It also makes it difficult to provide material uniformity. For this reason, the Ti content is preferably 0.10% or less, more preferably 0.05% or less.

V: 0.10% or Less

As with the case of titanium, vanadium may be added as required, because this element forms a fine carbonitride, and can contribute to making a fine micro structure. In view of obtaining this effect, vanadium is contained in an amount of preferably 0.005% or more, more preferably 0.02% or more. However, adding vanadium in large amounts seriously deteriorates elongation. For this reason, the V content is preferably 0.10% or less, more preferably 0.05% or less.

Cr: 0.50% or Less

Chromium is an element that contributes to enhancing strength by generating perlite and martensite, and may be added as required. In view of obtaining this effect, chromium is contained in an amount of preferably 0.01% or more, more preferably 0.10% or more, further preferably 0.20% or more. However, when contained in excess of 0.50%, chromium generates martensite in excess, and a chromium oxide occurs at the steel sheet surface during annealing. This often leads to poor plateability, and uneven plating. For this reason, the Cr content is preferably 0.50% or less, more preferably 0.30% or less.

Mo: 0.50% or Less

As with the case of chromium, molybdenum generates perlite and martensite, and contributes to enhancing strength by also generating carbides. In view of obtaining this effect, molybdenum is contained in an amount of preferably 0.01% or more, more preferably 0.10% or more. However, when contained in excess of 0.50%, molybdenum generates martensite in excess, and the hole expansion formability deteriorates. For this reason, the Mo content is preferably 0.50% or less, more preferably 0.30% or less.

Cu: 0.50% or Less

Copper is an element that contributes to enhancing strength by contributing to solid solution strengthening, and promotion of martensite and perlite generation, and may be added as required. In order to obtain these effects, copper is contained in an amount of preferably 0.01% or more. However, when the Cu content is more than 0.50%, the effect becomes saturated, and surface defects due to copper tend to occur. For this reason, the Cu content is preferably 0.10% or less, more preferably 0.05% or less.

Ni: 0.50% or Less

As with the case of copper, nickel is an element that contributes to enhancing strength by contributing to solid solution strengthening, and promotion of martensite and perlite generation, and may be added as required. In order to obtain these effects, nickel is contained in an amount of preferably 0.01% or more, more preferably 0.02% or more. When added with copper, nickel acts to reduce the surface defects due to copper, and it is effective to add nickel when adding copper. The Ni content is preferably 0.50% or less because the effect becomes saturated when the Ni content is more than 0.50%. The Ni content is more preferably 0.10% or less, further preferably 0.05% or less.

B: 0.01% or Less

Boron is an element that improves quenchability, and contributes to enhancing strength by promoting generation of a second phase, and may be added as required. In order to obtain this effect, boron is contained in an amount of preferably 0.0002% or more. More preferably, the boron content is 0.002% or more. With a B content of more than 0.01%, a second phase occurs in excess in the micro structure after hot rolling, and the material uniformity deteriorates. To prevent this, the B content is preferably 0.01% or less, more preferably 0.005% or less.

Ca and/or REM: 0.0050% or Less in Total

Ca and REM are elements that make the sulfide spherical in shape, and contribute to reducing the adverse effect of sulfides on hole expansion formability, and may be added as required. In order to obtain these effects, Ca and REM are contained in a total amount of preferably 0.0005% or more (the content of Ca or REM when only one of these elements is contained). The content of Ca and/or REM is more preferably 0.0030% or more. Because the effect becomes saturated when the total content is more than 0.0050%, the total content is preferably 0.0050% or less, more preferably 0.0040% or less.

The balance is Fe and unavoidable impurities. Examples of the unavoidable impurities include Sb, Sn, Zn, and Co. The acceptable contents of these elements are Sb: 0.03% or less, Sn: 0.10% or less, Zn: 0.10% or less, and Co: 0.10% or less. The effects according to aspects of the present invention will not be lost even when Ta, Mg, and Zr are contained in amounts used in common steel compositions.

Micro Structure

The steel sheets according to aspects of the present invention, including the plated steel sheet, have a steel structure that contains ferrite as a primary phase, and 2 to 12% of perlite, and 3% or less (including 0%) of martensite by volume, and in which the remainder is a low-temperature occurring phase, the ferrite having an average crystal grain diameter of 25 μm or less, the perlite having an average crystal grain diameter of 5 μm or less, the martensite having an average crystal grain diameter of 1.5 μm or less, and the perlite having a mean free path of 5.5 μm or more. Here and below, the volume fraction is a volume fraction with respect to the total micro structure.

In accordance with aspects of the present invention, the primary phase is ferrite. As used herein, "primary phase" means containing 82 to 98% of ferrite by volume. In accordance with aspects of the present invention, ferrite needs to be contained as the primary phase in view of providing desirable elongation and hole expansion formability. The lower limit is preferably 91% or more. The upper limit is preferably 96% or less.

When the ferrite has an average crystal grain diameter of more than 25 μm, joining of voids tends to occur at the time of hole expansion, and the desired hole expansibility cannot be obtained. It also makes it difficult to provide material uniformity. For this reason, the average grain diameter of ferrite is 25 μm or less, preferably 20 μm or less, more preferably 18 μm or less. The lower limit is, for example, 10 μm or more, though it is not particularly limited. The average aspect ratio of the ferrite phase is not particularly limited, and is preferably 3.5 or less in order to reduce joining of voids during the hole expansion. As used herein, "aspect ratio" is a value obtained by dividing the major axis of an equivalent ellipsoid by its minor axis.

With the perlite contained in the micro structure, tensile strength can be provided while maintaining elongation and hole expansion formability. The volume fraction of perlite is 2% or more because it is difficult to obtain high strength when the volume fraction of perlite is less than 2%. The volume fraction of perlite is preferably 5% or more. The upper limit of the volume fraction of perlite is 12% or less because the hole expansion formability deteriorates when the perlite is more than 12% by volume. The volume fraction of perlite is preferably 10% or less, more preferably 9% or less.

When the average crystal grain diameter of perlite is more than 5 μm, voids occur also at the interface between cementite and ferrite, and these voids easily join together, and cause deterioration of hole expansion formability. The average crystal grain diameter of perlite is preferably 4 μm or less. Here, perlite means a laminar structure with alternately occurring plate-shaped ferrite and cementite, and perlite generates in the process of cooling from prior austenite. Accordingly, the crystal grain diameter of perlite as used herein means the diameter of a prior austenite particle in such a laminate structure. The lower limit of the crystal grain diameter of perlite is not particularly limited, and is, for example, 3 μm or more.

In order to make the material uniformity of the steel sheet and the plated steel sheet desirable, the mean free path of the perlite is 5.5 μm or more. With a mean free path of less than 5.5 μm for the perlite, large variations occur in the mechanical properties of a coil along its width direction and longitudinal direction, and the voids easily join together during the hole expansion, with the result that the hole expansion formability deteriorates. The mean free path is preferably 6.0 μm or more. The upper limit of the mean free path of perlite is not particularly limited, and is preferably 20 μm or less, more preferably 10 μm or less. The mean free path of perlite is derived by using the method described below.

In order to provide high ductility and hole expansion formability, the volume fraction of martensite is 3% or less. When the volume fraction of martensite is more than 3%, large numbers of voids occur at the interface between martensite and ferrite at the time of punching, and the hole expansion formability deteriorates. The volume fraction of martensite is preferably 2% or less. The volume fraction of martensite may be 0%, provided that ductility and other required properties can be provided by other configurations.

The average crystal grain diameter of martensite is 1.5 μm or less. When the average crystal grain diameter of martensite is more than 1.5 μm, the voids generated at the time of punching during the hole expansion easily join together, and the hole expansion formability deteriorates. The average crystal grain diameter of martensite is preferably 1.0 μm or less. The lower limit is not particularly limited, and is, for example, 0.7 μm or more.

The micro structure may contain phases other than the ferrite, perlite, and martensite above. In this case, the remainder of the structure is a low-temperature occurring phases selected from, for example, unrecrystallized ferrite, bainite, retained austenite, and spherical cementite, or a mixed structure combining two or more of these low-temperature occurring phases. For formability, the remainder structure other than ferrite, perlite, and martensite is preferably less than 3.0% by volume in total. Accordingly, the remainder structure may be 0%.

Steel Sheet

The steel sheet has the composition and the micro structure described above. The steel sheet has a thickness of typically 0.4 mm to 3.2 mm, though it is not particularly limited.

Plated Steel Sheet

The plated steel sheet according to aspects of the present invention is a plated steel sheet having a plating layer on the steel sheet according to aspects of the present invention. The plating layer is not particularly limited, and may be, for example, a hot-dip plating layer, or an electroplating layer. The plating layer may be an alloyed plating layer. The plating layer is preferably a galvanized layer. The galvanized layer may contain aluminum or magnesium. A hot-dip zinc-aluminum-magnesium alloyed plating (a Zn—Al—Mg plating layer) is also preferred. In this case, it is preferable that the Al content be 1 mass % to 22 mass %, the Mg content be 0.1 mass % to 10 mass %, and the balance be zinc. The Zn—Al—Mg plating layer may contain at least one selected from Si, Ni, Ce, and La in a total amount of 1 mass % or less, in addition to Zn, Al, and Mg. The plated metal is not particularly limited, and other metals, for example, aluminum may be used for plating, other than zinc.

The composition of the plating layer is not particularly limited either, and the plating layer may have a common composition. For example, in the case of a hot-dip galvanized layer or a hot-dip galvannealed layer, the composition typically contains Fe: 20 mass % or less, Al: 0.001 mass % to 1.0 mass %, one or more selected from Pb, Sb, Si, Sn, Mg, Mn, Ni, Cr, Co, Ca, Cu, Li, Ti, Be, Bi, and REM in a total amount of 0 mass % to 3.5 mass %, and the balance Zn and unavoidable impurities. In accordance with aspects of the present invention, it is preferable to provide a hot-dip galvanized layer deposited with 20 to 120 g/m$^2$ of plating each side, and a hot-dip galvannealed layer formed by alloying such a hot-dip galvanized layer. This is because a coating weight of less than 20 g/m$^2$ makes it difficult to provide corrosion resistance. With a coating weight of more than 120 g/m$^2$, the plating may suffer from poor resistance against detachment. As a guide, the Fe content in the plating layer is less than 7 mass % when the plating layer is a hot-dip galvanized layer, and 7 to 20 mass % when the plating layer is a hot-dip galvannealed layer.

Hot-Rolled Steel Sheet Producing Method

The method for producing a hot-rolled steel sheet is a method that includes:

hot rolling a steel material (steel slab) of the composition above under the conditions where the rolling reduction of the final pass of the finish rolling is 12% or more, the rolling reduction of the preceding pass of the final pass is 15% or more, the total rolling reduction of the finish rolling is 85 to 95%, and the finish rolling delivery temperature is 850 to 950° C.;

subjecting the steel after the hot rolling to first cooling in which the steel is cooled to a cooling stop temperature at a first average cooling rate of 50° C./s or more, the cooling stop temperature being 700° C. or less;

subjecting the steel after the first cooling to second cooling in which the steel is cooled to a coiling temperature at a second average cooling rate of 5° C./s or more; and coiling the steel at a coiling temperature of 450 to 650° C.

In the following descriptions, "temperature" means steel sheet surface temperature, unless otherwise specifically stated. Steel sheet surface temperature can be measured with a radiation thermometer or the like.

Preferably, the steel slab (steel material) used is produced by continuous casting to prevent macro segregation of the components. The steel material also may be produced by ingot casting, or thin slab casting.

For hot rolling, it is preferable to start hot rolling of the cast steel slab at 1,150 to 1,270° C. without reheating, or after reheating the steel material to 1,150 to 1,270° C. In a preferred hot-rolling condition, the steel slab is hot rolled at a hot-rolling start temperature of 1,150 to 1,270° C. In accordance with aspects of the present invention, the steel slab produced may be processed by the traditional method where the steel slab is cooled to room temperature, and reheated, or may be processed using a low-energy process, for example, such as direct transfer rolling/direct rolling, in which the steel slab is placed in a heating furnace while it is still warm, without cooling, or the steel slab is rolled immediately after retaining heat, or is rolled directly after being cast.

Rolling Reduction of Final Pass of Finish Rolling is 12% or More

Rolling Reduction of Preceding Pass of Final Pass is 15% or More

In accordance with aspects of the present invention, the rolling reduction of the final pass of the finish rolling, and the rolling reduction of the preceding pass of the final pass are controlled within appropriate ranges. The rolling reduction of the final pass of the finish rolling is set to 12% or more to introduce large numbers of shear bands in austenite grains, and increase the nucleation site of ferrite transformation after hot rolling so that a fine micro structure of hot-rolled sheet is obtained. The mean free path of perlite after annealing can improve when the hot-rolled steel sheet has a fine uniform structure. With a final pass rolling reduction of less than 12%, the desired mean free path cannot be provided after annealing, and the material uniformity and hole expansion formability deteriorate. For this reason, the rolling reduction of the final pass is 12% or more, preferably 13% or more.

In order to more effectively achieve material uniformity in a coil, the rolling reduction of the preceding pass of the final pass is set to 15% or more, in addition to controlling the rolling reduction of the final pass. By controlling the rolling reduction of the preceding pass of the final pass, the strain accumulation effect increases, and larger numbers of shear bands are introduced in austenite grains. This further increases the nucleation site of ferrite transformation, and the hot-rolled sheet has an even finer structure. That is, the material uniformity improving effect further improves. When the rolling reduction of the preceding pass of the final pass is less than 15%, the effect that produces fine ferrite grains in the hot-rolled steel sheet structure becomes insufficient, and it becomes difficult to provide a mean free path for perlite. For this reason, the rolling reduction of the preceding pass of the final pass is 15% or more, preferably 17% or more.

In view of a rolling load, the upper limit of the rolling reductions of the final pass and the preceding pass of the final pass is preferably less than 40%.

Total Rolling Reduction of Finish Rolling is 85 to 95%

In order to make a fine micro structure in the hot-rolled steel sheet, the total rolling reduction of the finish rolling needs to be 85% or more. The total rolling reduction of the final rolling needs to be 95% or less because it otherwise results in excess introduction of dislocation, which not only increases the retained unrecrystallized ferrite after annealing, but produces an overly high hot-rolling load, with the result that the cost increases.

Finish Rolling Delivery Temperature: 850 to 950° C.

The hot rolling must end in an austenite single phase, in order to make the microstructure uniform, and to reduce the anisotropy of the material, and improve the elongation and hole expansion formability after annealing (heating and cooling after the cold rolling). To this end, the finish rolling delivery temperature is 850° C. or more, preferably 870° C. or more. A final rolling finishing temperature of more than 950° C. produces a coarse micro structure of hot-rolled steel sheet, and deteriorates the properties after annealing. The finish rolling delivery temperature is therefore 850 to 950° C. The upper limit is preferably 920° C. or less.

The hot rolling is followed by first cooling, in which the steel is cooled to a cooling stop temperature at a first average cooling rate of 50° C./s or more, the cooling stop temperature being 700° C. or less.

The cooling after the hot rolling is performed to control the precipitation of the perlite in the hot-rolled steel sheet. Controlling the precipitation of the perlite in the hot-rolled steel sheet contributes to making fine ferrite and martensite in the final micro structure, and providing a mean free path for the perlite. When the first cooling rate to 700° C. is less than 50° C./s, perlite formation accelerates, and coarse perlite occurs. This makes it difficult to produce a fine micro structure of steel sheet, and deterioration of hole expansion formability and material uniformity occurs after the annealing. When the lower limit of the temperature region in which the average cooling rate is controlled in the first cooling is higher than 700° C., the ferrite coarsens, and the material becomes nonuniform, making it difficult to provide a mean free path for perlite in the end. For this reason, the first cooling is performed under the condition that the first average cooling rate to the cooling stop temperature is 50° C./s or more. The first average cooling rate is preferably 200° C./s or less. The cooling stop temperature is 700° C. or less. Typically, the cooling stop temperature is 600° C. or more. It is to be noted that the cooling stop temperature is higher than the coiling temperature described below.

The first cooling is followed by second cooling, which is performed under the condition that the second average cooling rate to the winding temperature is 5° C./s or more.

When the second average cooling rate to the winding temperature is less than 5° C./s, ferrite and perlite coarsen, and it becomes difficult to provide a fine micro structure in the end. Accordingly, the second average cooling rate is 5° C./s or more. The second average cooling rate is preferably 40° C./s or less. When the lower limit of the temperature region in which the second average cooling rate is adjusted in the foregoing range is higher than 650° C., ferrite and perlite coarsen, and it becomes difficult to provide a fine micro structure after annealing. For this reason, the second average cooling rate is adjusted as above, and the cooling stop temperature (winding temperature) of the second cooling is 650° C. or less. When the cooling stop temperature of the second cooling is less than 450° C., martensite partially occurs in the steel sheet, and localized concentration of carbon and manganese occurs in the martensite. This makes it difficult to provide a mean free path for perlite after annealing. For this reason, the cooling stop temperature is 450° C. or more. Aspects of the present invention use the two-stage cooling process to obtain the desired micro structure. Specifically, the second average cooling rate is lower than the first average cooling rate.

Coiling Temperature: 450 to 650° C.

When the coiling temperature is higher than 650° C., ferrite and perlite coarsen, and the micro structure becomes nonuniform, making it difficult to provide a fine micro structure after annealing. Accordingly, the upper limit of coiling temperature is 650° C., preferably 630° C. or less. With a coiling temperature of less than 450° C., it becomes difficult to provide a mean free path for perlite after annealing. Accordingly, the coiling temperature is 450° C. or more, preferably 550° C. or more.

Once coiled, the steel sheet is cooled by air or by some other means, and is used to produce a cold-rolled full hard steel sheet, as described below. When the hot-rolled steel sheet is to be sold in the form of an intermediate product, the hot-rolled steel sheet is typically prepared into a commercial product after being coiled and cooled.

Cold-Rolled Full-Hard Steel Sheet Producing Method

The method for producing a cold-rolled full-hard steel sheet according to aspects of the present invention is a method that produces a cold-rolled full-hard steel sheet by cold rolling the hot-rolled steel sheet produced by using the method described above.

The cold rolling conditions are appropriately set according to, for example, factors such as the desired thickness. In accordance with aspects of the present invention, the steel sheet is cold rolled at a rolling reduction of preferably 30% or more. When the rolling reduction is low, ferrite recrystallization may not be promoted, and unrecrystallized ferrite may occur in excess, and cause deterioration of ductility and hole expansion formability. The rolling reduction of cold rolling is typically 95% or less.

The hot-rolled steel sheet is pickled before cold rolling to descale the sheet surface. The pickling conditions may be appropriately set.

Steel Sheet Producing Method

The steel sheet producing method includes a method that produces a steel sheet by heating and cooling the cold-rolled full-hard steel sheet (single method), and a method in which the cold-rolled full-hard steel sheet is heated and cooled to produce a heat-treated sheet, and the heat-treated sheet is heated and cooled to produce a steel sheet (double method). The single method is described first.

Dew Point in Temperature Region of 600° C. or More is −40° C. or Less

When the dew point in a temperature region of 600° C. or more is −40° C. or less, decarburization from the steel sheet surface during annealing can be reduced, and the tensile strength of 440 MPa or more specified in accordance with aspects of the present invention can be stably achieved. The steel sheet strength may fall below 440 MPa as a result of decarburization when the dew point in the foregoing temperature region is higher than −40° C. Accordingly, the dew point in the temperature region of 600° C. or more is set to −40° C. or less. The lower limit of the atmospheric dew point is not particularly limited, and is preferably −80° C. or more because the effect becomes saturated, and creates a cost disadvantage when the dew point is less than −80° C. It is to be noted here that the temperature in the foregoing temperature region is based on the surface temperature of the steel sheet. That is, the dew point is adjusted in the foregoing range when the steel sheet surface temperature is in the foregoing temperature region.

Maximum Achieving Temperature is 730 to 900° C.

When the maximum achieving temperature is less than 730° C., recrystallization of the ferrite phase does not proceed sufficiently, and excess unrecrystallized ferrite occurs in the micro structure, with the result that formability deteriorates. Formation of a second phase, necessary in accordance with aspects of the present invention, also becomes difficult. When the maximum achieving temperature is higher than 900° C., it becomes difficult to provide a fine micro structure, and the desired average crystal grain diameter cannot be obtained. Accordingly, the maximum achieving temperature is 730 to 900° C. The lower limit is preferably 750° C. or more. The upper limit is preferably 850° C. or less.

The heating conditions in the heating are not particularly limited. It is, however, preferable that the average heating rate be 2 to 50° C./s. This is because a fine micro structure may not be easily obtained with an average heating rate of less than 2° C./s. When the average heating rate is higher than 50° C./s, the steel may reach a temperature where γ generation takes place, before recrystallization sufficiently proceeds. This may result in excess unrecrystallized ferrite at the time of final annealing.

Retention Time at Maximum Achieving Temperature is 15 to 600 Seconds

When the retention time is less than 15 seconds, ferrite recrystallization does not proceed sufficiently, and excess unrecrystallized ferrite will be present in the micro structure, with the result that formability deteriorates. Formation of a second phase, necessary in accordance with aspects of the present invention, also becomes difficult. When the retention time is more than 600 seconds, ferrite coarsens, and the hole expansion formability deteriorates. For this reason, the retention time is 600 seconds or less.

Average Cooling Rate to Cooling Stop Temperature is 3 to 30° C./s Cooling Stop Temperature is 600° C. or Less The heating must be followed by cooling to the cooling stop temperature at an average cooling rate of 3 to 30° C./s. With an average cooling rate of less than 3° C./s, the volume fraction of perlite overly increases, and it becomes difficult to provide hole expansion formability. With an average cooling rate of more than 30° C./s, excess generation of martensite phase occurs, and it becomes difficult to provide hole expansion formability. An average cooling rate of more than 30° C./s also causes local transformation, and makes it difficult to provide a mean free path for perlite. When the temperature region in which the cooling rate is controlled is higher than 600° C., excess generation of perlite occurs, and the predetermined volume fraction cannot be obtained for the different phases of the micro structure, with the result that ductility (formability) and hole expansion formability deteriorate. A cooling stop temperature of 600° C. or less is therefore necessary, as stated above. The cooling stop temperature is preferably 400° C. or more.

When the steel sheet is to be sold, the steel sheet is cooled to room temperature after being cooled in the foregoing cooling process, or after the temper rolling described below, before being prepared into a commercial product.

The following describes the double method. In the double method, the cold-rolled full-hard steel sheet is heated to make a heat-treated sheet. The method that produces the heat-treated sheet is the method for producing a heat-treated sheet according to aspects of the present invention.

The heating that produces the heat-treated sheet is performed at a heating temperature of 700 to 900° C. When performed under this condition, the heating can promote production of a fine micro structure. The heating temperature is therefore 700 to 900° C. The effect becomes insufficient when the heating temperature is less than 700° C. With a heating temperature of more than 900° C., it becomes difficult to obtain a fine micro structure in the subsequent heating of the heat-treated sheet.

The heating is followed by cooling. The cooling conditions are not particularly limited. Typically, the cooling is performed at an average cooling rate of 1 to 30° C./s.

The heating method is not particularly limited. Preferably, the heating is performed using a continuous annealing line (CAL), or a batch annealing furnace (BAF).

In the double method, the heat-treated sheet is further heated and cooled. The heating and cooling conditions (including a dew point, a maximum achieving temperature, a retention time, an average cooling rate, and a cooling stop temperature) are the same as those described for the cold-rolled full-hard steel sheet in conjunction with the single method. As such, these will not be described again.

The steel sheet obtained by the method described above may be subjected to temper rolling, and the temper-rolled steel sheet may be regarded as the steel sheet according to aspects of the present invention. The stretch rate is preferably 0.05 to 2.0%.

Plated Steel Sheet Producing Method

The method for producing a plated steel sheet according to aspects of the present invention is a method that produces a plated steel sheet by plating the steel sheet obtained in the manner described above.

For example, the plating process may be hot-dip galvanization, or a process that involves alloying after hot-dip galvanization. Annealing and galvanization may be continuously performed in a single line. As another example, a plating layer may be formed by electroplating such as Zn—Ni alloy electroplating, or by hot-dip zinc-aluminum-magnesium alloy plating. Though the above description focuses on galvanization, the type of plated metal is not particularly limited, and the plating may be, for example, Zn plating, or Al plating. The plating process includes a process in which plating is performed after annealing, and a process in which annealing and plating are continuously performed in a plating line.

As an example, the following describes hot-dip galvanization.

The steel sheet temperature of the steel sheet dipped in a plating bath ranges preferably from (hot-dip galvanization bath temperature −40)° C. to (hot-dip galvanization bath temperature +50)° C. When the temperature of the steel sheet dipped in a plating bath is below (hot-dip galvanization bath temperature −40)° C., the molten zinc may partially solidify upon dipping the steel sheet in the plating bath, and the appearance of the plating may deteriorate. The preferred lower limit is therefore (hot-dip galvanization bath temperature −40)° C. The plating bath temperature increases when the temperature of the steel sheet dipped in a plating bath is above (hot-dip galvanization bath temperature +50)° C. This poses a problem in mass production. The preferred upper limit is therefore (hot-dip galvanization bath temperature +50)° C.

The hot-dip plating may be followed by an alloying treatment in a temperature region of 450 to 600° C. By performing an alloying treatment in a temperature region of 450 to 600° C., the Fe concentration in the plating becomes 7 to 15%, and improves the plating adhesion, and the corrosion resistance after the coating. Alloying does not proceed sufficiently when the alloying temperature is less than 450° C. This may lead to poor sacrificial anticorrosion effect, and poor slidability. When the alloying temperature is more than 600° C., alloying proceeds predominantly, and the powdering property deteriorates.

For productivity, a series of processes including the annealing (heating and cooling of the sheet sheets, including the cold-rolled full-hard steel sheet), the hot-dip plating, and the alloying treatment is preferably performed in a Continuous Galvanizing Line (CGL). Preferably, the hot-dip galvanization uses a galvanization bath containing 0.10 to 0.20% of aluminum. The plating may be followed by wiping to adjust the coating weight.

As described above in conjunction with the plating layer, the plating is preferably Zn plating. It is possible, however, to use other metals, such as in Al plating.

EXAMPLES

Examples of the present invention are described below. However, the present invention is not to be limited by the following Examples, and may be implemented in various modifications as appropriately made within the scope conforming to the gist of the present invention, and such modifications all fall within the technical scope of the present invention.

Steels of the compositions shown in Table 1 were cast to produce slabs. The slab was hot rolled into a hot-rolled steel sheet (thickness: 3.2 mm) under the conditions where the hot-rolling heating temperature is 1,250° C., and the finish rolling delivery temperature (FDT), the rolling reduction (pass 2) of the final pass of the finish rolling of hot rolling, and the rolling reduction (pass 1) of the preceding pass of the final pass are as shown in Table 2. The hot-rolled steel sheet was cooled to a first cooling temperature at the first average cooling rate (cooling rate 1) shown in Table 2, and to a coiling temperature at the second average cooling temperature (cooling rate 2), and was coiled at a coiling temperature (CT). The resulting hot-rolled sheet was pickled, and cold rolled to produce a cold-rolled sheet (thickness: 1.4 mm; the cold-rolled sheet corresponds to the cold-rolled full-hard steel sheet). In a Continuous Galvanizing Line, the cold-rolled sheet was annealed under the conditions shown in Table 2, and was subjected to hot-dip galvanization. This was followed by an alloying treatment at the temperatures shown in Table 2 to obtain hot-dip galvannealed steel sheets. As shown in Table 2, some of the steel sheets were subjected to a first heat treatment after the cold rolling. As shown in Table 2, alloying of the plating was not performed for some of the steel sheets. The plating was performed under the following conditions.

Galvanization bath temperature: 460° C.,

Al concentration in galvanization bath: 0.14 mass % (when alloying is performed), 0.18 mass % (when alloying is not performed)

Coating weight: 45 g/m$^2$ (each side)

TABLE 1

| Steel | Composition (mass %) | | | | | | | | |
|---|---|---|---|---|---|---|---|---|---|
| type | C | Si | Mn | P | S | Al | N | Other components | Remarks |
| A | 0.09 | 0.01 | 1.42 | 0.02 | 0.002 | 0.03 | 0.003 | — | Compliant steel |
| B | 0.16 | 0.02 | 0.75 | 0.02 | 0.005 | 0.02 | 0.003 | Ti: 0.03 | Compliant steel |
| C | 0.08 | 0.03 | 1.25 | 0.02 | 0.002 | 0.03 | 0.003 | Nb: 0.02 | Compliant steel |
| D | 0.12 | 0.02 | 0.95 | 0.02 | 0.002 | 0.03 | 0.003 | V: 0.02 | Compliant steel |
| E | 0.11 | 0.01 | 1.20 | 0.02 | 0.001 | 0.02 | 0.002 | Cr: 0.21 | Compliant steel |
| F | 0.08 | 0.03 | 1.15 | 0.02 | 0.002 | 0.03 | 0.003 | Mo: 0.12 | Compliant steel |
| G | 0.09 | 0.01 | 1.33 | 0.02 | 0.003 | 0.03 | 0.001 | Cu: 0.01 | Compliant steel |
| H | 0.10 | 0.02 | 1.24 | 0.03 | 0.004 | 0.02 | 0.002 | Ni: 0.02 | Compliant steel |
| I | 0.08 | 0.05 | 1.02 | 0.03 | 0.003 | 0.03 | 0.003 | B: 0.002 | Compliant steel |
| J | 0.09 | 0.02 | 1.11 | 0.03 | 0.002 | 0.03 | 0.002 | Ca: 0.001, REM: 0.002 | Compliant steel |
| K | 0.20 | 0.02 | 0.84 | 0.02 | 0.003 | 0.03 | 0.003 | — | Comparative example |

TABLE 1-continued

| Steel type | Composition (mass %) C | Si | Mn | P | S | Al | N | Other components | Remarks |
|---|---|---|---|---|---|---|---|---|---|
| L | 0.05 | 0.03 | 1.55 | 0.02 | 0.002 | 0.03 | 0.003 | — | Comparative example |
| M | 0.15 | 0.03 | 0.33 | 0.02 | 0.005 | 0.03 | 0.003 | — | Comparative example |
| N | 0.12 | 0.02 | 1.99 | 0.02 | 0.002 | 0.02 | 0.003 | — | Comparative example |

TABLE 2

| | | Hot rolling | | | | | | | | | Final annealing | | | | | | |
|---|---|---|---|---|---|---|---|---|---|---|---|---|---|---|---|---|---|
| Sample No. | Steel type | Total rolling reduction in finish rolling % | Pass 1 % | Pass 2 % | FDT ° C. | Cooling rate 1*1 ° C./s | Cooling stop temp. ° C. | Cooling rate 2*2 ° C./s | CT ° C. | First annealing Heating temp. ° C. | Dew point*3 ° C. | Maximum achieving temp. ° C. | Retention time Seconds | Cooling rate 3*4 ° C. | Cooling stop temp. ° C. | Alloying temp. ° C. | Remarks |
| 1 | A | 91 | 18 | 13 | 880 | 100 | 660 | 20 | 620 | — | −45 | 800 | 300 | 5 | 525 | 525 | PE |
| 2 | B | 91 | 18 | 12 | 880 | 100 | 680 | 20 | 620 | — | −46 | 820 | 300 | 5 | 525 | — | PE |
| 3 | C | 91 | 18 | 13 | 880 | 90 | 660 | 20 | 600 | — | −48 | 780 | 300 | 5 | 525 | 525 | PE |
| 4 | D | 91 | 18 | 14 | 880 | 100 | 680 | 20 | 620 | — | −48 | 830 | 300 | 8 | 525 | 525 | PE |
| 5 | E | 91 | 18 | 15 | 880 | 120 | 680 | 20 | 450 | — | −49 | 820 | 300 | 8 | 525 | 525 | PE |
| 6 | F | 91 | 20 | 12 | 880 | 110 | 650 | 30 | 600 | — | −45 | 820 | 300 | 10 | 525 | 600 | PE |
| 7 | G | 91 | 18 | 15 | 880 | 100 | 660 | 25 | 550 | — | −46 | 820 | 600 | 8 | 525 | — | PE |
| 8 | H | 91 | 18 | 15 | 880 | 150 | 680 | 25 | 500 | — | −47 | 850 | 600 | 10 | 525 | 525 | PE |
| 9 | I | 91 | 20 | 15 | 880 | 80 | 680 | 25 | 600 | — | −47 | 820 | 600 | 10 | 525 | — | PE |
| 10 | J | 91 | 18 | 15 | 880 | 80 | 680 | 25 | 620 | — | −47 | 800 | 300 | 5 | 525 | 525 | PE |
| 11 | A | 91 | 5 | 18 | 880 | 100 | 680 | 20 | 620 | — | −46 | 800 | 300 | 8 | 525 | 525 | CE |
| 12 | A | 91 | 18 | 5 | 880 | 100 | 680 | 25 | 620 | — | −46 | 840 | 600 | 8 | 525 | — | CE |
| 13 | B | 91 | 18 | 15 | 880 | 15 | 680 | 20 | 600 | — | −47 | 800 | 300 | 8 | 525 | 600 | CE |
| 14 | B | 91 | 18 | 13 | 880 | 100 | 750 | 25 | 600 | — | −46 | 800 | 300 | 5 | 525 | 525 | CE |
| 15 | B | 91 | 18 | 13 | 880 | 100 | 650 | 1 | 600 | — | −46 | 800 | 600 | 5 | 525 | 525 | CE |
| 16 | A | 91 | 20 | 14 | 880 | 100 | 650 | 35 | 300 | — | −46 | 780 | 600 | 5 | 525 | 525 | CE |
| 17 | A | 91 | 18 | 14 | 880 | 100 | 650 | 10 | 700 | — | −46 | 850 | 600 | 5 | 525 | 525 | CE |
| 18 | A | 91 | 18 | 14 | 880 | 100 | 650 | 20 | 600 | — | −46 | 680 | 300 | 5 | 525 | 525 | CE |
| 19 | B | 91 | 18 | 15 | 880 | 100 | 650 | 20 | 600 | — | −46 | 950 | 600 | 5 | 525 | 525 | CE |
| 20 | C | 91 | 18 | 13 | 880 | 100 | 650 | 25 | 600 | — | −46 | 820 | 600 | 1 | 525 | 525 | CE |
| 21 | A | 91 | 18 | 15 | 880 | 120 | 660 | 25 | 600 | — | −46 | 830 | 600 | 5 | 700 | 525 | CE |
| 22 | K | 91 | 18 | 15 | 880 | 80 | 650 | 20 | 580 | — | −46 | 830 | 600 | 5 | 525 | 525 | CE |
| 23 | L | 91 | 18 | 15 | 880 | 100 | 650 | 20 | 580 | — | −46 | 800 | 300 | 5 | 525 | 525 | CE |
| 24 | M | 91 | 20 | 15 | 880 | 80 | 650 | 20 | 580 | — | −46 | 800 | 600 | 5 | 525 | 525 | CE |
| 25 | N | 91 | 18 | 15 | 880 | 100 | 650 | 20 | 580 | — | −46 | 780 | 300 | 5 | 525 | 525 | CE |
| 26 | A | 91 | 18 | 15 | 880 | 100 | 650 | 20 | 600 | 750 | −40 | 820 | 300 | 5 | 525 | 525 | PE |
| 27 | B | 91 | 18 | 15 | 880 | 100 | 650 | 20 | 580 | 750 | −54 | 800 | 600 | 5 | 525 | 600 | PE |
| 28 | C | 91 | 18 | 15 | 880 | 120 | 650 | 20 | 580 | 780 | −52 | 800 | 600 | 5 | 525 | 525 | PE |
| 29 | B | 91 | 18 | 15 | 880 | 120 | 650 | 20 | 580 | — | −38 | 840 | 600 | 5 | 525 | 525 | CE |

*1First average cooling rate to cooling stop temperature
*2Second average cooling rate to winding temperature
*3Dew point in furnace in a temperature range of 600° C. or more
*4Average cooling rate to cooling stop temperature
PE: Example of the present invention;
CE: Comparative example A JIS 5 tensile test strip was collected from the steel sheet in such an orientation that the direction orthogonal to the rolling direction was the longitudinal direction (tensile direction) of the test strip. The test strip was then measured for tensile strength (TS), total elongation (EL), and yield strength (YS) in a tensile test (JIS Z2241(1998)). In accordance with aspects of the present invention, the steel sheet was determined as having high strength when it had a TS (MPa) of 440 MPa or more, and was determined as having desirable elongation when it had an EL of 35% or more.

For hole expansion formability, the steel sheet was punched to make a hole (ϕ=10 mm) with 12.5% clearance according to the Japan Iron and Steel Federation (JFS T1001 (1996)) standards. The steel sheet was set on a tester in such an orientation that the burr was on the die side, and was measured for hole expansion rate (λ) by shaping the hole with a 60° conical punch. The steel sheet was determined as having desirable hole expansibility when it had a hole expansion rate λ (%) of 65% or more.

Material uniformity was evaluated as follows.

A JIS 5 test piece was collected from the hot-dip galvanized steel sheet, and from the hot-dip galvannealed steel sheet. The test piece was collected from a position at the width center of the sheets, and from a position at ⅛ of the width of the sheets from each side (⅛ of the total width) in such an orientation that the tensile direction was parallel to the rolling direction. The test piece was then measured for YS and TS in a tensile test conducted according to JIS Z 2241 (2010). From the measured results, ΔYS and ΔTS were calculated as the difference between the measured value at the width center and the measured value at the ⅛ width position (the mean value of the measured values from the two ⅛ width positions on the both sides of the sheet). Here, the difference was calculated as the absolute value of the difference obtained by subtracting the property value at the ⅛ width position from the property value at the width center. In accordance with aspects of the present invention, the steel sheet was determined as being desirable in terms of material uniformity when ΔYS≤25 MPa, and ΔTS ≤25 MPa. Material variation is evaluated at the width center and the ⅛ width position because the tensile strength difference between, for example, the width center of the plated steel sheet and the position at ¼ of the sheet width from the edge of the plated steel sheet (¼ width position) does not reflect the material quality near the edges, and does not yield a sufficient evaluation result for material stability in width direction. On the other hand, the material stability of the plated steel sheet can be appropriately evaluated by evaluating the tensile strength difference between the width center and the ⅛ width position closer to the edge.

The volume fractions of the ferrite, perlite, and martensite in the steel sheet were obtained in the following fashion. A cross section taken along the rolling direction of the steel sheet was polished, corroded with 3% nital, and observed at a ¼ position from surface in thickness direction, using a SEM (scanning electron microscope) at 2,000, and 5,000 times magnifications. The area percentage was then measured according to the point counting method (ASTM E562-83 (1988)), and the measured area percentage was recorded as a volume fraction. For the calculation of the average crystal grain diameters of ferrite, perlite, and martensite, the area of each phase can be calculated by incorporating pictures that have identified the ferrite, perlite, and martensite crystal grains from pictures of the microstructure, using the Image-Pro available from Media Cybernetics. The average crystal grain diameters of ferrite, perlite, and martensite were determined by calculating the diameters of corresponding circles, and averaging the calculated values.

The mean free path of perlite was calculated by finding the center of gravity of perlite using the Image-Pro, on the assumption that perlite was uniformly dispersed without being overly undistributed. The calculations were made according to the following equation.

$$L_M = \frac{d_M}{2}\left(\frac{4\pi}{3f}\right)^{\frac{1}{3}} \quad \text{[Math. 1]}$$

$L_M$: Mean free path of Perlite (μm)

$d_M$: Average crystal grain diameter of perlite (μm)

π: Circumference ratio f: Area percentage (=volume fraction)(%)

The low-temperature occurring phase as the remainder can be distinguished by scanning or transmission electron microscopy. Bainite is a structure containing cementite, and bainitic ferrite, which is plate-like in shape and having higher dislocation density than polygonal ferrite. Spherical cementite is a form of cementite having a spherical shape. The presence or absence of retained austenite was determined in the following manner. A steel sheet surface was polished over a depth of ¼ of sheet thickness from surface, and the integral intensities of X-ray diffraction lines were measured for the {200} plane, {211} plane, {220} plane of ferrite of iron, and for the {200} plane, {220} plane, {311} plane of austenite in the steel by X-ray diffractometry at an acceleration voltage of 50 keV, using the Ka line of molybdenum as a radiation source (device: RINT 2200 manufactured by Rigaku Corporation). From the measured values, the volume fraction of the retained austenite was determined using the formulae in pages 26, and 62 to 64 of the X-Ray Diffraction Handbook (2000, Rigaku Corporation). The retained austenite was determined as being present when the volume fraction was 1% or more, and absent when the volume fraction was less than 1%. As shown in Table 3, the retained austenite was not observable in any of the microstructures.

Table 3 shows the measurement results for tensile characteristics, hole expansion rate, material uniformity, and micro structure.

As can be seen from the results shown in Table 3, the examples of the present invention had a tensile strength of 440 MPa or more, an elongation of 35% or more, and a hole expansion rate of 65% or more, and the material uniformity was desirable. On the other hand, Comparative Examples were inferior in one or more of tensile strength, elongation, hole expansion rate, and material uniformity.

TABLE 3

| | Micro structure | | | | | | | | | Tensile characteristics | | | Hole expansion rate | Material uniformity | | |
|---|---|---|---|---|---|---|---|---|---|---|---|---|---|---|---|---|
| | Ferrite | | | Martensite | | Perlite | | | Remainder structure | | | | | | | |
| Sample No. | Volume fraction (%) | Average grain diameter (μm) | Average aspect ratio | Volume fraction (%) | Average grain diameter (μm) | Volume fraction (%) | Average grain diameter (μm) | Free mean path (μm) | Type | YS MPa | TS MPa | EL % | λ % | ΔYS MPa | ΔTS MPa | Remark |
| 1 | 91 | 14 | 2.1 | 1 | 1.1 | 7 | 4 | 7.8 | B | 298 | 452 | 37 | 68 | 19 | 18 | PE |
| 2 | 92 | 16 | 2.2 | 0 | — | 8 | 4 | 7.5 | — | 288 | 461 | 37 | 71 | 21 | 16 | PE |
| 3 | 92 | 15 | 2.1 | 1 | 0.8 | 6 | 3 | 6.2 | SC | 294 | 443 | 36 | 75 | 18 | 21 | PE |
| 4 | 95 | 14 | 2.3 | 0 | — | 5 | 3 | 6.6 | — | 279 | 466 | 36 | 70 | 19 | 22 | PE |
| 5 | 92 | 13 | 3.1 | 2 | 0.9 | 6 | 4 | 8.2 | — | 282 | 449 | 38 | 68 | 18 | 18 | PE |
| 6 | 92 | 16 | 2.4 | 0 | — | 7 | 4 | 7.8 | SC | 302 | 464 | 36 | 70 | 21 | 22 | PE |
| 7 | 94 | 15 | 2.5 | 1 | 1.0 | 5 | 3 | 6.6 | — | 296 | 455 | 37 | 66 | 15 | 19 | PE |
| 8 | 91 | 18 | 2.1 | 0 | — | 9 | 4 | 7.2 | — | 289 | 454 | 37 | 68 | 16 | 18 | PE |
| 9 | 92 | 17 | 2.3 | 0 | — | 8 | 4 | 7.5 | — | 301 | 474 | 36 | 71 | 19 | 19 | PE |
| 10 | 93 | 18 | 1.9 | 0 | — | 7 | 3 | 5.9 | — | 289 | 445 | 39 | 69 | 16 | 18 | PE |
| 11 | 90 | 16 | 2.5 | 1 | 1.2 | 9 | 2 | 3.6 | — | 300 | 454 | 35 | 68 | 26 | 31 | CE |
| 12 | 90 | 17 | 2.8 | 0 | — | 10 | 3 | 5.2 | — | 294 | 461 | 37 | 63 | 23 | 28 | CE |
| 13 | 91 | 16 | 2.9 | 0 | — | 9 | 6 | 10.8 | — | 301 | 456 | 36 | 57 | 28 | 20 | CE |
| 14 | 91 | 21 | 2.8 | 0 | — | 9 | 3 | 5.4 | — | 283 | 449 | 36 | 60 | 30 | 24 | CE |
| 15 | 93 | 26 | 4.2 | 0 | — | 7 | 7 | 13.7 | — | 284 | 451 | 33 | 61 | 25 | 20 | CE |
| 16 | 89 | 17 | 2.6 | 2 | 1.4 | 8 | 2 | 3.7 | B | 281 | 444 | 36 | 59 | 29 | 28 | CE |
| 17 | 94 | 27 | 3.1 | 0 | — | 5 | 4 | 8.8 | SC | 293 | 449 | 34 | 63 | 26 | 22 | CE |
| 18 | 98 | 23 | 2.5 | 0 | — | 0 | — | — | SC | 254 | 384 | 39 | 72 | 18 | 16 | CE |

TABLE 3-continued

| Sample No. | Micro structure: Ferrite Volume fraction (%) | Ferrite Average grain diameter (μm) | Ferrite Average aspect ratio | Martensite Volume fraction (%) | Martensite Average grain diameter (μm) | Perlite Volume fraction (%) | Perlite Average grain diameter (μm) | Perlite Free mean path (μm) | Remainder structure Type | Tensile characteristics YS MPa | TS MPa | EL % | Hole expansion rate λ % | Material uniformity ΔYS MPa | ΔTS MPa | Remark |
|---|---|---|---|---|---|---|---|---|---|---|---|---|---|---|---|---|
| 19 | 87 | 28 | 4.1 | 0 | — | 13 | 8 | 12.7 | — | 301 | 464 | 33 | 61 | 27 | 28 | CE |
| 20 | 86 | 18 | 2.3 | 0 | — | 14 | 5 | 7.8 | — | 312 | 488 | 33 | 54 | 23 | 31 | CE |
| 21 | 87 | 17 | 2.4 | 0 | — | 13 | 6 | 9.5 | — | 322 | 484 | 35 | 57 | 24 | 26 | CE |
| 22 | 87 | 16 | 3.3 | 2 | 1.8 | 13 | 9 | 14.3 | — | 325 | 485 | 34 | 51 | 21 | 31 | CE |
| 23 | 99 | 19 | 2.2 | 0 | — | 1 | 1 | 3.7 | — | 271 | 401 | 38 | 68 | 27 | 21 | CE |
| 24 | 89 | 18 | 2.8 | 0 | — | 10 | 3 | 5.2 | SC | 281 | 412 | 38 | 68 | 28 | 20 | CE |
| 25 | 92 | 17 | 2.5 | 4 | 2.1 | 3 | 2 | 5.2 | B | 339 | 501 | 32 | 45 | 31 | 33 | CE |
| 26 | 96 | 12 | 1.8 | 0 | — | 6 | 3 | 6.2 | — | 291 | 448 | 40 | 77 | 16 | 17 | PE |
| 27 | 95 | 12 | 1.9 | 0 | — | 6 | 3 | 6.2 | — | 289 | 454 | 40 | 76 | 16 | 15 | PE |
| 28 | 94 | 11 | 1.3 | 1 | 0.7 | 7 | 3 | 5.9 | — | 284 | 451 | 41 | 79 | 17 | 19 | PE |
| 29 | 97 | 20 | 2.8 | 0 | — | 3 | 3 | 7.8 | — | 291 | 431 | 39 | 62 | 18 | 21 | CE |

Remainder structure,
B: bainite,
SC: spherical cementite
PE: Example of the present invention;
CE: Comparative example

The invention claimed is:

1. A steel sheet of a composition comprising, in mass %, C: 0.07 to 0.19%, Si: 0.09% or less, Mn: 0.50 to 1.60%, P: 0.05% or less, S: 0.01% or less, Al: 0.01 to 0.10%, N: 0.010% or less, and the balance Fe and unavoidable impurities, and of a micro structure that contains ferrite as a primary phase, and 2 to 12% of perlite, and 3% or less of martensite by volume, and in which the remainder is a low-temperature occurring phase, the ferrite having an average crystal grain diameter of 25 μm or less, the perlite having an average crystal grain diameter of 5 μm or less, the martensite having an average crystal grain diameter of 1.5 μm or less, and the perlite having a mean free path of 5.5 μm or more, the mean free path being determined by the following equation:

$$L_M = \frac{d_M}{2}\left(\frac{4\pi}{3f}\right)^{\frac{1}{3}}$$

wherein $L_M$: Mean free path of Perlite (μm), $d_M$: Average crystal grain diameter of perlite (μm), π: Circumference ratio, and f: Area percentage (%), and the steel sheet having a tensile strength of 440 MPa or more.

2. The steel sheet according to claim 1, wherein the composition further comprises, in mass %, at least one selected from Group A and B, Group A: at least one selected from
Nb: 0.10% or less,
Ti: 0.10% or less, and
V: 0,10% or less,
Group B: at least one selected from
Cr: 0.50% or less,
Mo: 0.50% or less,
Cu: 0.50% or less,
Ni: 0.50% or less,
B: 0.01% or less, and
a total of 0.0050% or less of Ca and/or REM.

3. A plated steel sheet comprising a plating layer on a surface of the steel sheet of claim 1.

4. A plated steel sheet comprising a plating layer on a surface of the steel sheet of claim 2.

5. The plated steel sheet according to claim 3, wherein the plating layer is a hot-dip galvanized layer, or a hot-dip galvannealed layer.

6. The plated steel sheet according to claim 4, wherein the plating layer is a hot-dip galvanized layer, or a hot-dip galvannealed layer.

7. A method for producing a hot-rolled steel sheet, the method comprising:

hot rolling a steel slab of the composition of claim 1 under the conditions where a rolling reduction of a final pass of finish rolling is 12% or more, a rolling reduction of a preceding pass of the final pass is 15% or more, a total rolling reduction of the finish rolling is 85 to 95%, and a finish rolling delivery temperature is 850 to 950° C.;

subjecting the steel after the hot rolling to first cooling in which the steel is cooled to a cooling stop temperature at a first average cooling rate of 50° C./s or more, the cooling stop temperature being 700° C. or less;

subjecting the steel after the first cooling to second cooling in which the steel is cooled to a coiling temperature at a second average cooling rate of 5° C./s or more; and coiling the steel at a coiling temperature of 450 to 650° C.

8. A method for producing a hot-rolled steel sheet, the method comprising:

hot rolling a steel slab of the composition of claim 2 under the conditions where a rolling reduction of a final pass of finish rolling is 12% or more, a rolling reduction of a preceding pass of the final pass is 15% or more, a total rolling reduction of the finish rolling is 85 to 95%, and a finish rolling delivery temperature is 850 to 950° C.;

subjecting the steel after the hot rolling to first cooling in which the steel is cooled to a cooling stop temperature at a first average cooling rate of 50° C./s or more, the cooling stop temperature being 700° C. or less;

subjecting the steel after the first cooling to second cooling in which the steel is cooled to a coiling temperature at a second average cooling rate of 5° C./s or more; and coiling the steel at a coiling temperature of 450 to 650° C.

9. A method for producing a cold-rolled full-hard steel sheet, the method comprising pickling and cold rolling the hot-rolled steel sheet obtained by the method of claim 7.

10. A method for producing a cold-rolled full-hard steel sheet, the method comprising pickling and cold rolling the hot-rolled steel sheet obtained by the method of claim 8.

11. A method for producing a steel sheet, comprising:

heating the cold-rolled full-hard steel sheet obtained by the method of claim 9, the cold-rolled full-hard steel sheet being heated under the conditions where the dew point in a temperature range of 600° C. or more is −40° C. or less, and a maximum achieving temperature is 730 to 900° C.;

retaining the heated cold-rolled full-hard steel sheet at the maximum achieving temperature for a retention time of 15 to 600 seconds; and cooling the retained cold-rolled full-hard steel sheet to a cooling stop temperature at an average cooling rate of 3 to 30° C./s, the cooling stop temperature being 600° C. or less.

12. A method for producing a steel sheet, comprising:

heating the cold-rolled full-hard steel sheet obtained by the method of claim 10, the cold-rolled full-hard steel sheet being heated under the conditions where the dew point in a temperature range of 600° C. or more is −40° C. or less, and a maximum achieving temperature is 730 to 900° C.;

retaining the heated cold-rolled full-hard steel sheet at the maximum achieving temperature for a retention time of 15 to 600 seconds; and cooling the retained cold-rolled full-hard steel sheet to a cooling stop temperature at an average cooling rate of 3 to 30° C./s, the cooling stop temperature being 600° C. or less.

13. A method for producing a heat-treated sheet, comprising:

heating the cold-rolled full-hard steel sheet obtained by the method of claim 9, the cold-rolled full-hard steel sheet being heated at a heating temperature of 700 to 900° C.; and cooling the cold-rolled full-hard steel sheet.

14. A method for producing a heat-treated sheet, comprising:

heating the cold-rolled full-hard steel sheet obtained by the method of claim 10, the cold-rolled full-hard steel sheet being heated at a heating temperature of 700 to 900° C.; and cooling the cold-rolled full-hard steel sheet.

15. A method for producing a steel sheet, comprising:

heating the heat-treated sheet obtained by the method of claim 13, the heat-treated sheet being heated under the conditions where the dew point in a temperature range of 600° C. or more is −40° C. or less, and a maximum achieving temperature is 730 to 900° C.;

retaining the heated heat-treated sheet at the maximum achieving temperature for a retention time of 15 to 600 seconds; and cooling the retained heat-treated sheet to a cooling stop temperature at an average cooling rate of 3 to 30° C./s, the cooling stop temperature being 600° C. or less.

16. A method for producing a steel sheet, comprising:

heating the heat-treated sheet obtained by the method of claim 14, the heat-treated sheet being heated under the conditions where the dew point in a temperature range of 600° C. or more is −40° C. or less, and a maximum achieving temperature is 730 to 900° C.;

retaining the heated heat-treated sheet at the maximum achieving temperature for a retention time of 15 to 600 seconds; and cooling the retained heat-treated sheet to a cooling stop temperature at an average cooling rate of 3 to 30° C./s, the cooling stop temperature being 600° C. or less.

17. A method for producing a plated steel sheet, the method comprising plating a surface of the steel sheet obtained by the method of claim 11.

18. A method for producing a plated steel sheet, the method comprising plating a surface of the steel sheet obtained by the method of claim 12.

19. A method for producing a plated steel sheet, the method comprising plating a surface of the steel sheet obtained by the method of claim 15.

20. A method for producing a plated steel sheet, the method comprising plating a surface of the steel sheet obtained by the method of claim 16.

21. The method according to claim 17, wherein the plating is a process that involves hot-dip galvanization, and alloying at 450 to 600° C.

22. The method according to claim 18, wherein the plating is a process that involves hot-dip galvanization, and alloying at 450 to 600° C.

23. The method according to claim 19, wherein the plating is a process that involves hot-dip galvanization, and alloying at 450 to 600° C.

24. The method according to claim 20, wherein the plating is a process that involves hot-dip galvanization, and alloying at 450 to 600° C.

* * * * *